US006003760A

United States Patent [19]

Abercrombie

[11] Patent Number: 6,003,760

[45] Date of Patent: Dec. 21, 1999

[54] TWO-WAY Z-FOLD BUSINESS FORM MAILER

[75] Inventor: James Harold Abercrombie, Little Elm, Tex.

[73] Assignee: Laser Compositions, Inc., Carrollton, Tex.

[21] Appl. No.: 09/100,473

[22] Filed: Jun. 19, 1998

[51] Int. Cl.[6] ..... B65D 27/06

[52] U.S. Cl. ..... 229/305; 229/92.1

[58] Field of Search ..... 229/92.1, 92.3, 229/305

[56] References Cited

U.S. PATENT DOCUMENTS

| | | |
|---|---|---|
| 1,091,172 | 3/1914 | Thayer . |
| 2,317,335 | 4/1943 | Whitman . |
| 2,396,221 | 3/1946 | Yancey . |
| 2,402,821 | 6/1946 | Kosteling . |
| 2,910,222 | 10/1959 | Bermingham, Jr. et al. . |
| 3,113,716 | 12/1963 | Howard . |
| 3,126,148 | 3/1964 | Hanson . |
| 3,143,279 | 8/1964 | Black . |
| 3,152,800 | 10/1964 | Hanson . |
| 3,184,150 | 5/1965 | Hubbard . |
| 3,228,586 | 1/1966 | Hayes, Jr. . |
| 3,255,952 | 6/1966 | Black . |
| 3,557,519 | 1/1971 | Lyon, Jr. . |
| 3,652,007 | 3/1972 | MacDougall . |
| 3,791,572 | 2/1974 | Gendron . |
| 3,802,618 | 4/1974 | Wiessner . |
| 3,837,565 | 9/1974 | Johnsen . |
| 3,946,938 | 3/1976 | Kranz . |
| 3,981,435 | 9/1976 | Johnsen . |
| 3,995,808 | 12/1976 | Keho . |
| 4,044,942 | 8/1977 | Sherwood . |
| 4,055,294 | 10/1977 | Traise . |
| 4,081,127 | 3/1978 | Steidinger . |
| 4,375,868 | 3/1983 | Slotar et al. . |
| 4,487,360 | 12/1984 | Fisher et al. . |
| 4,668,211 | 5/1987 | Lubotta et al. . |
| 4,669,652 | 6/1987 | Seguin . |
| 4,706,878 | 11/1987 | Lubotta et al. . |
| 4,715,531 | 12/1987 | Stewart et al. . |
| 4,754,915 | 7/1988 | Steidinger . |
| 4,756,468 | 7/1988 | Jenkins . |
| 4,775,095 | 10/1988 | Emmott . |
| 4,778,101 | 10/1988 | Paquin . |
| 4,830,269 | 5/1989 | Jenkins . |
| 4,889,278 | 12/1989 | Steidinger . |
| 4,896,823 | 1/1990 | Taylor . |
| 4,899,926 | 2/1990 | Spaulding . |
| 4,915,287 | 4/1990 | Volk et al. . |
| 4,928,875 | 5/1990 | Hutchinson . |
| 4,951,864 | 8/1990 | Dicker . |
| 4,960,237 | 10/1990 | Bendel . |

(List continued on next page.)

FOREIGN PATENT DOCUMENTS

| | | |
|---|---|---|
| 804433 | 1/1969 | Canada . |
| 2400465 | 4/1979 | France . |
| 2409920 | 7/1979 | France . |
| 337326 | 10/1935 | Italy . |
| 3212352 | 9/1991 | Japan . |
| 418253 | 1/1992 | Japan . |
| 1507667 | 9/1989 | U.S.S.R. . |
| 535458 | 9/1941 | United Kingdom . |

*Primary Examiner*—Stephen P. Garbe
*Attorney, Agent, or Firm*—David H. Judson

[57] ABSTRACT

A business form is provided that can be constructed into a two-way mailer. The form contains pre-printed non-varying information. The form user prints variable information on the front face of the form. The form is foldable in a Z-fold about two substantially parallel fold lines. The fold lines divide the form into three generally equally sized sections. Segments of pressure-sensitive adhesive material are disposed on front and rear faces of the form for sealing open outer edges of the form after it has been folded to form a sealed mailer. A recipient of the mailer can open the mailer and construct a return envelope from it. For this purpose, the form includes segments of remoistenable adhesive disposed on the rear face of form to seal open outer edges of the form.

12 Claims, 6 Drawing Sheets

U.S. PATENT DOCUMENTS 5,167,739 12/1992 Hutchinson et al. .
5,174,493 12/1992 File .
5,201,464 4/1993 File .
5,253,798 10/1993 Lombardo ..... 229/92.1
5,263,637 11/1993 Simson .
5,288,014 2/1994 Meyers et al. .
5,289,972 3/1994 Sauerwine et al. ..... 229/305
5,290,225 3/1994 Younger .
5,294,041 3/1994 Whiteside .
5,314,110 5/1994 Lombardo .
5,346,123 9/1994 Lombardo .
5,366,145 11/1994 Sauerwine ..... 229/304
5,370,304 12/1994 Sauerwine et al. .
5,375,764 12/1994 Sauerwine .
5,425,500 6/1995 Sauerwine .
5,513,795 5/1996 Sauerwine ..... 229/305
5,553,774 9/1996 Goodno .
5,829,670 11/1998 Lombardo et al. ..... 229/92.1

TWO-WAY Z-FOLD BUSINESS FORM MAILER

BACKGROUND OF THE INVENTION

1. Technical Field

The present invention relates generally to business form mailers and, more particularly, to a two-way Z-fold business form mailer.

2. Description of the Related Art

Business form mailers are commonly used for mass mailing a variety of materials. These materials typically include documents having variable information such as invoices and academic grade reports. Many of these mailers are two-way forms, i.e., they can be constructed into a pre-addressed return envelope that the recipient can use to mail something to the original sender. For example, in the case of invoices, a payment check can be sent in the return envelope.

A common type of such a two-way business mailer is a C-fold mailer, which is disclosed in, e.g., U.S. Pat. Nos. 5,201,464 and 5,290,225. These mailers comprise a single sheet pre-printed with non-variable information, i.e., information that does not vary among recipients. Such information includes, e.g., the original sender's name and address. The original sender or form user prints variable information on the sheet using a printer. Variable information includes, e.g., the recipient's name and address and other information specific to the particular recipient. The form user then folds the printed form in a C-fold to create the mailer. As the form is folded, pressure-sensitive adhesive on the form causes the form edges to be sealed and the return envelope formed simultaneously.

One significant drawback to the C-fold mailer is that for effective use of printable space, both sides of the sheet are printed. Therefore, if a simplex printer is used for printing the variable information, the form is first fed through the printer for printing on one side, turned 180°, and then fed through the printer again for printing the second side. This lengthens the time needed to prepare the forms and adds further steps in the procedure. Alternatively, a user can use a duplex printer, which allows both faces of the form to be printed in a single feeding. Duplex printers, however, take substantially twice as much time to process forms as simplex printers. In addition, duplex printers cause significantly greater paper curl. Duplex printers are also more expensive than simplex printers and may not be readily available for all users. (Most laser printers are simplex printers.)

BRIEF SUMMARY OF THE INVENTION

Thus, a primary object of the invention is to provide a two-way business form mailer designed to effectively use printable space on one side of the form such that the form can be printed with variable information using a simplex printer in a single feeding.

Another object of the invention is to provide a Z-fold, two-way business form mailer.

A further object of the invention is to provide a two-way business form mailer that can quickly and easily be prepared for mailing, opened by a recipient, and constructed into a return envelope.

These and other objects are accomplished by a Z-fold business form mailer in accordance with the invention. The Z-fold mailer comprises a single sheet having opposite front and rear faces. It has first, second, third and fourth edges.

The sheet includes a first line of weakness extending substantially parallel to and proximate the first edge. The first line of weakness and the first edge define a first tear-away strip therebetween. The sheet also includes a second line of weakness extending substantially parallel to and proximate the second edge. The second line of weakness and the second edge define a second tear-away strip therebetween.

First and second fold lines extend across the sheet substantially perpendicular to the first and second edges. These fold lines divide the sheet into first, second and third sections. The first section is between the third edge and the first fold line. The second section is between the first and second fold lines. The third section is between the second fold line and the fourth edge.

The form also includes substantially parallel third and fourth lines of weakness on opposite sides of and proximate the first fold line. The third line of weakness is in the first section, and the fourth line of weakness is in the second section.

A fifth line of weakness is in the third section of the form proximate the fourth edge of the sheet. This line of weakness is aligned with the third and fourth lines of weakness when the sheet is folded in a Z-fold at the first and second fold lines to define a third tear-away strip.

Adhesive material is disposed on the first and second tear-away strips on the front face of the sheet for joining the first and second sections when the sheet is folded about the first fold line in a Z-fold.

The form also includes adhesive material on at least one of the second and third sections on the rear face of the sheet for joining the second and third sections when the sheet is folded about the second fold line in a Z-fold.

Also, adhesive material for constructing a return envelope disposed on at least one of the second and third sections on the front face of the sheet for joining at least some of an outer area of the second and third sections after the first and second sections have been folded about the second fold line.

The business form can be quickly and easily prepared for use. It is printed with variable information on one side of the form using a simplex printer in a single feeding. It can be easily folded and sealed for mailing. The addressee can easily open the mailer and construct a return envelope from it.

The foregoing has outlined some of the more pertinent objects of the present invention. These objects should be construed to be merely illustrative of some of the more prominent features and applications of the invention. Many other beneficial results can be attained by applying the disclosed invention in a different manner or modifying the invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings, in which.

DETAILED DESCRIPTION OF THE PREFERRED EMBODIMENT

Figure 1:
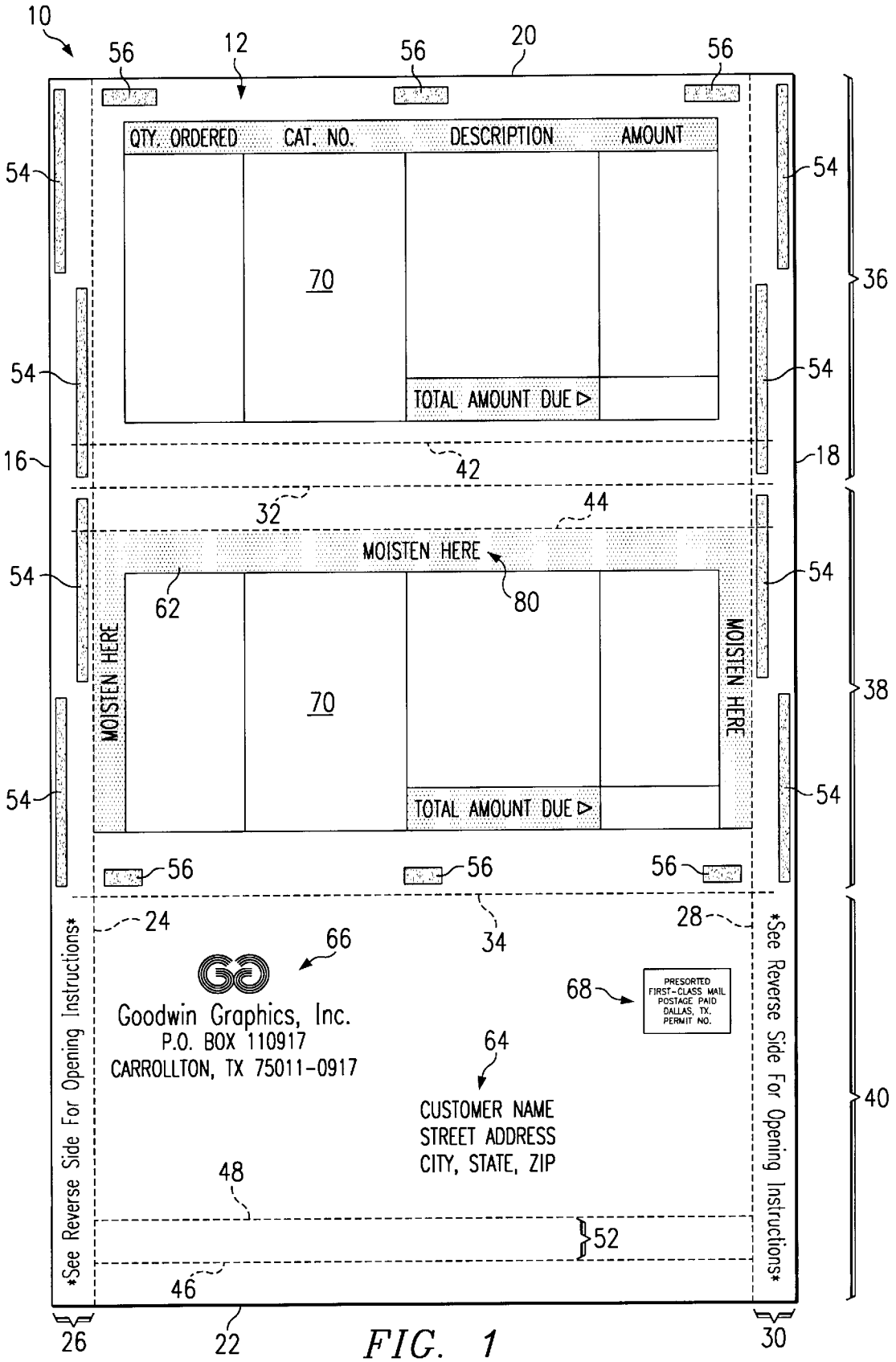
FIG. 1 is a front view of an unfolded Z-fold business form mailer in accordance with the invention.
Figure 2:
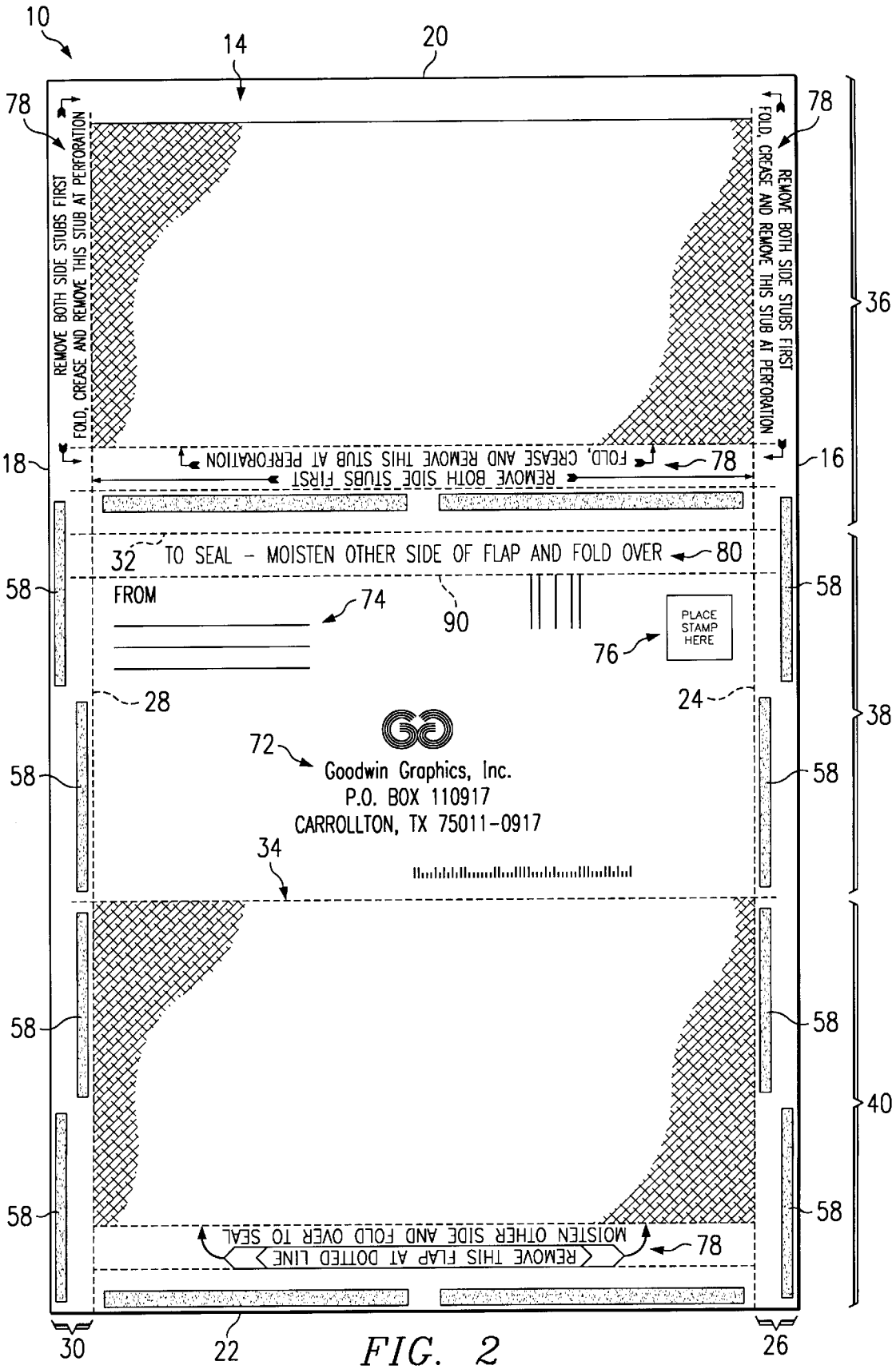
FIG. 2 is a rear view of the unfolded mailer.

FIGS. 1 and 2 are front and rear views, respectively, of an unfolded two-way business form mailer 10 in accordance with the invention. (The business form 10 can also be described as a business form intermediate since further steps of printing variable information and folding and sealing the form have yet to be performed.)

The business form 10 comprises a single sheet having opposite first and second faces 12, 14 shown in FIGS. 1 and 2, respectively. (The first and second faces 12, 14 are also referred to herein as front and rear faces 12, 14, respectively.) The form 10 is preferably rectangular having a first edge 16, a second edge 18, a third edge 20, and a fourth edge 22.

Though a variety of sizes are possible, the form 10 is preferably of standard sheet size such as 8½×11 inches or 8½×14 inches to facilitate feeding in standard laser printers.

The form 10 is preferably a paper product, and it is of suitable weight and thickness to enable the mailer and return envelope formed therefrom to meet postal regulations.

The form 10 includes several lines of weakness (preferably lines of perforation) for forming tear strips. The tear strips facilitate opening the mailer after it has been sealed. A first line of weakness 24 extends substantially parallel to and proximate the first edge 16. The first line of weakness 24 and the first edge 16 define a first tear-away strip 26 therebetween. The form 10 also includes a second line of weakness 28 extending substantially parallel to and proximate the second edge 18. The second line of weakness 28 and the second edge 18 define a second tearaway strip 30 therebetween.

The form 10 also includes fold lines, about which the form 10 is folded. First and second fold lines 32, 34 extend across the width of the form 10 substantially perpendicular to the first and second edges 16, 18. The first and second fold lines 32, 34 divide the form 10 into generally equally sized first, second and third sections 36, 38, 40. The first section 36 is located between the third edge 20 and the first fold line 32. The second section 38 is located between the first and second fold lines 32, 34. The third section 40 is located between the second fold line 34 and the fourth edge 22.

The form 10 also includes substantially parallel third and fourth lines of weakness 42, 44 on opposite sides of and proximate the first fold line 32. The third line of weakness 42 is located in the first section 36, and the fourth line of weakness 44 is located in the second section 38.

Figure 4:
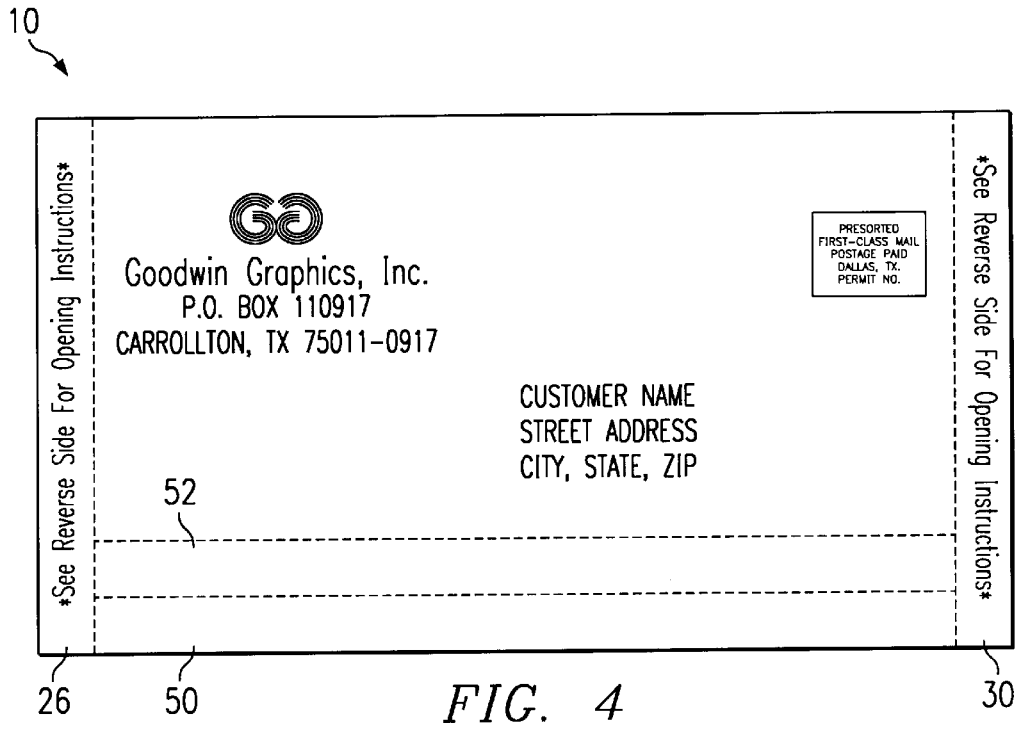
FIG. 4 is a front view of a folded and sealed mailer.

The form 10 also includes substantially parallel fifth and sixth lines of weakness 46, 48 in the third section 40 proximate the fourth edge 22 of the form 10. The fifth line of weakness 46 is located between the sixth line of weakness 48 and the fourth edge 22. As will be described further below, the fifth line of weakness 46 is aligned with the third and fourth lines of weakness 42, 44 when the form 10 is folded. The third, fourth and fifth lines of weakness 42, 44, 46 form a third tear-away strip 50 (most readily apparent in FIGS. 4 and 5).

Also, the fifth and sixth lines of weakness 46, 48 define a fourth tear-away strip 52 therebetween.

The form 10 also includes segments of adhesive material, preferably pressure-sensitive adhesive, disposed on both the front and rear faces 12, 14 to enable the mailer to be sealed when the form 10 is folded in a Z-fold. Segments of pressure-sensitive adhesive material 54 are disposed on the first and second tear-away strips 26, 30 on the front face 12 of the form 10 for enabling the first and second sections 36, 38 to be joined when the form 10 is folded about the first fold line 32.

Segments of pressure-sensitive adhesive 56 are also disposed on the first and second sections 35, 38 on the front face 12 of the form 10 for joining the third edge 20 of the form 10 to the second section 38 proximate the second fold line 34 when the form 10 is folded about the first fold line 32.

Additional segments of pressure sensitive adhesive 58 are disposed on the rear face 14 of the form 10 on the second and third sections 38, 40 as shown in FIG. 2. The second and third sections 38, 40 are joined when the form 10 is folded about the second fold line 34 in creating the mailer as will be described below.

Figure 8:
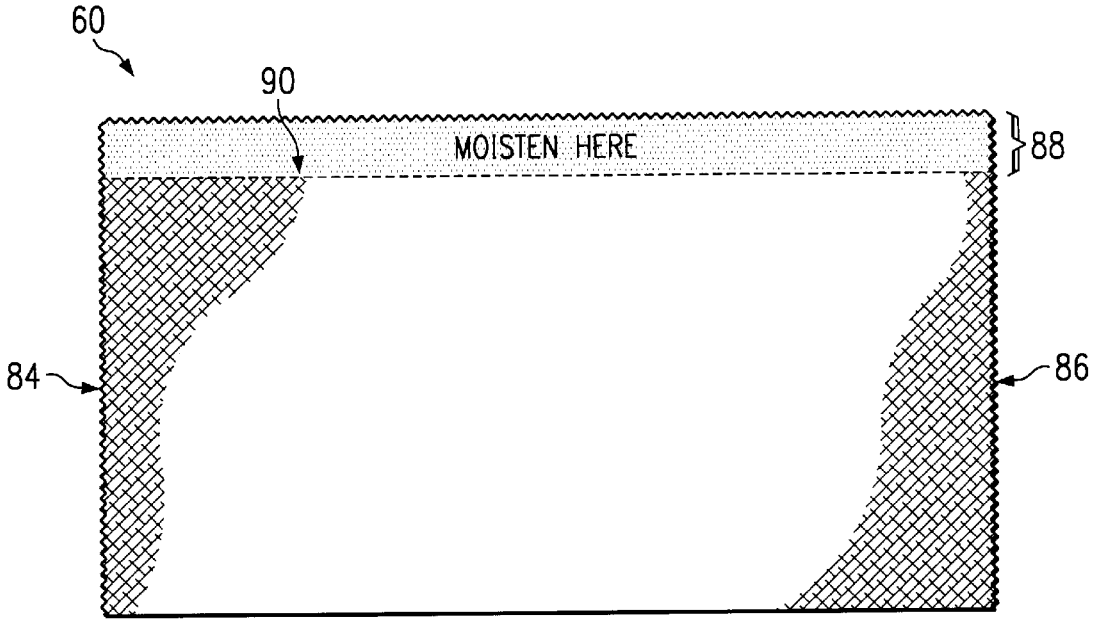
FIG. 8 is a rear view of an unsealed return envelope.

The form 10 can be constructed into a return envelope 60 (shown in FIGS. 8 and 9) by a recipient as will be further described below. For this purpose, the form 10 includes adhesive material 62, preferably remoistenable adhesive, disposed preferably on the second section 38 on the front face 12 of the form 10 as shown in FIG. 1. (Alternatively, while not shown, the adhesive can also be disposed on the third section 40 of the front face 12 of the form or on both the second and third sections.) The adhesive 62 is arranged on the form in an upside-down U-shape about the periphery of the upper and side portions of the second section 38. The adhesive 62 permits the outer area of the second and third sections 38, 40 to be adhered together to form the return envelope 60 when the form is folded about the second fold line 34. The inner areas of the second and third sections 38, 40 are unattached and adapted for receiving an enclosure (not shown).

The third section 40 on the front face 12 on the form 10 (shown in FIG. 1) includes a central area, at which variable information, specifically the original recipient's name and address information 64, is printed by the form user. The third section 40 also includes an area at the upper left corner, on which non-variable information, e.g., as shown, the user's name, address and optional graphics 66, is pre-printed. However, pre-printing is not required as the information 66 can be printed by the user at the same time the variable recipient address information 64 is printed. The third section 40 also includes an area at the upper right corner containing pre-printed information 68 on payment of postal fees.

The first and second sections 38, 40 on the front face of the form 10 include space at which variable and pre-printed information 70 can be included. For example, in the mailer embodiment shown in the drawings, this space contains an invoice. The variable information printed in the first and second sections 36, 38 may be identical since, as will be described below, the recipient of the mailer will remove the first section 36 to keep for his or her records and return the second and third sections 38, 40 to the original sender.

As shown in FIG. 2, the second section 38 on the rear face 14 of the form 10 includes pre-printed, non-variable information. A central portion of the second section 38 includes name and address information 72 of the addressee of the return envelope 60 when it is constructed. The addressee in the example form is the original sender. The upper left corner of the second section 38 preferably includes blank lines 74, on which the sender of the return envelope 60 can fill in a return address. The upper right corner preferably includes information 76 indicating where postage stamps should be placed for postal delivery. (Though not shown, it may indicate pre-paid postal information.)

The form 10 also includes pre-printed opening instructions 78 and pre-printed instructions 80 for constructing the return envelope 60 on both the front and rear faces 12, 14.

Operation

A plurality of business forms 10 containing pre-printed, non-varying information are provided by a form manufacturer to the form user. The form user prints variable information on the front face 12 of the form 10 using a simplex printer. All of the variable information can be printed on the form 10 in a single feeding through the simplex printer since only the front face of the form is printed. A variety of such printers can be used including impact printers and non-impact printers (such as laser printers).

Figure 3:
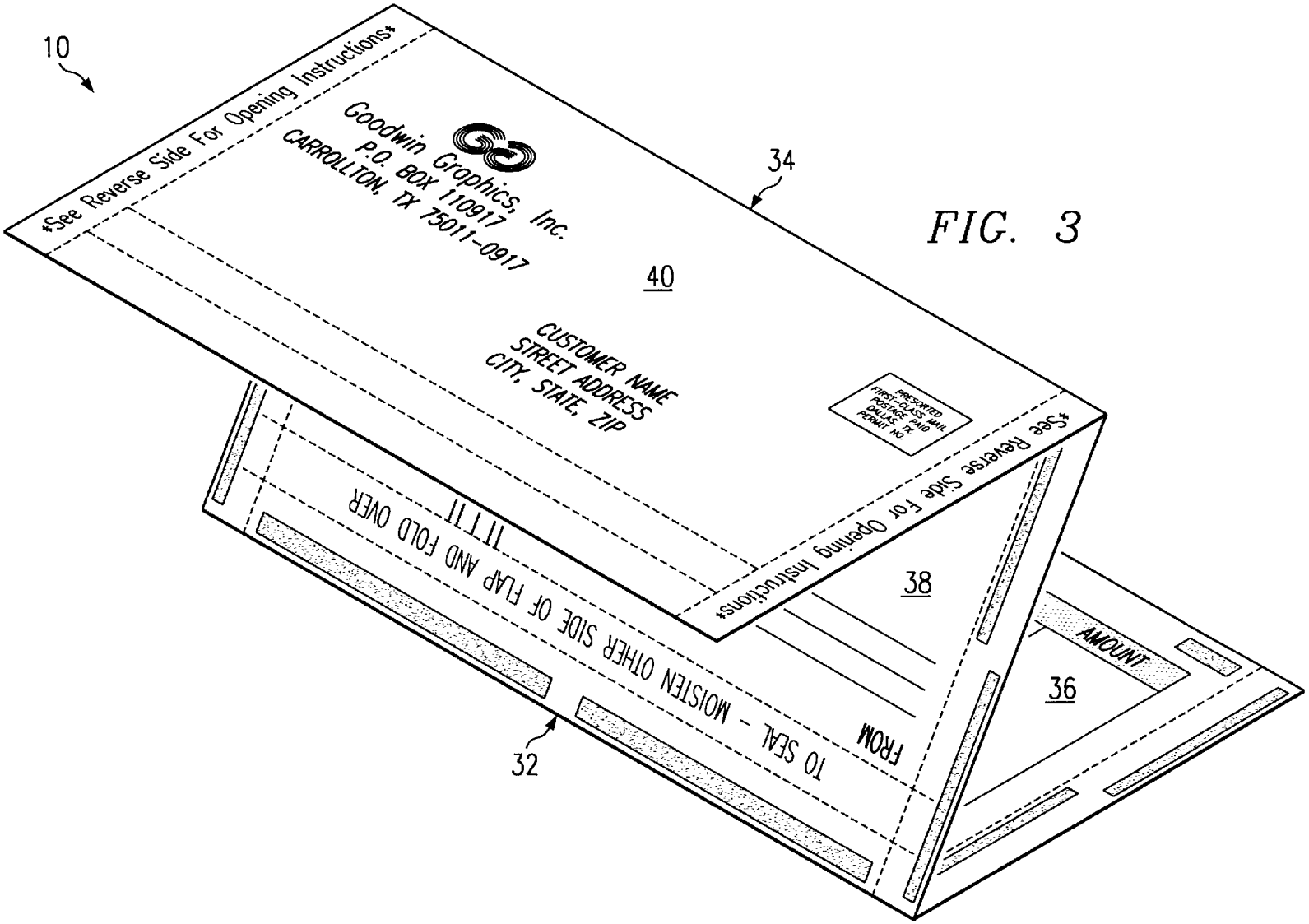
FIG. 3 is a perspective view of the mailer being folded in a Z-fold.

Thereafter, the form 10 is folded in a Z-fold manner as shown in FIG. 3. Specifically, the form 10 is folded about the first fold line 32, bringing the front faces of the first and second sections 36, 38 together. The form 10 is also folded about the second fold line 34, bringing the rear faces of the second and third sections 38, 40 together. Pressure applied to the form 10 during the folding process will cause the form to be sealed along the segments of pressure-sensitive adhesive 54, 56, 58. The resulting folded and sealed mailer (illustrated in FIG. 4) is now ready for delivery to the designated addressee.

Figure 5:
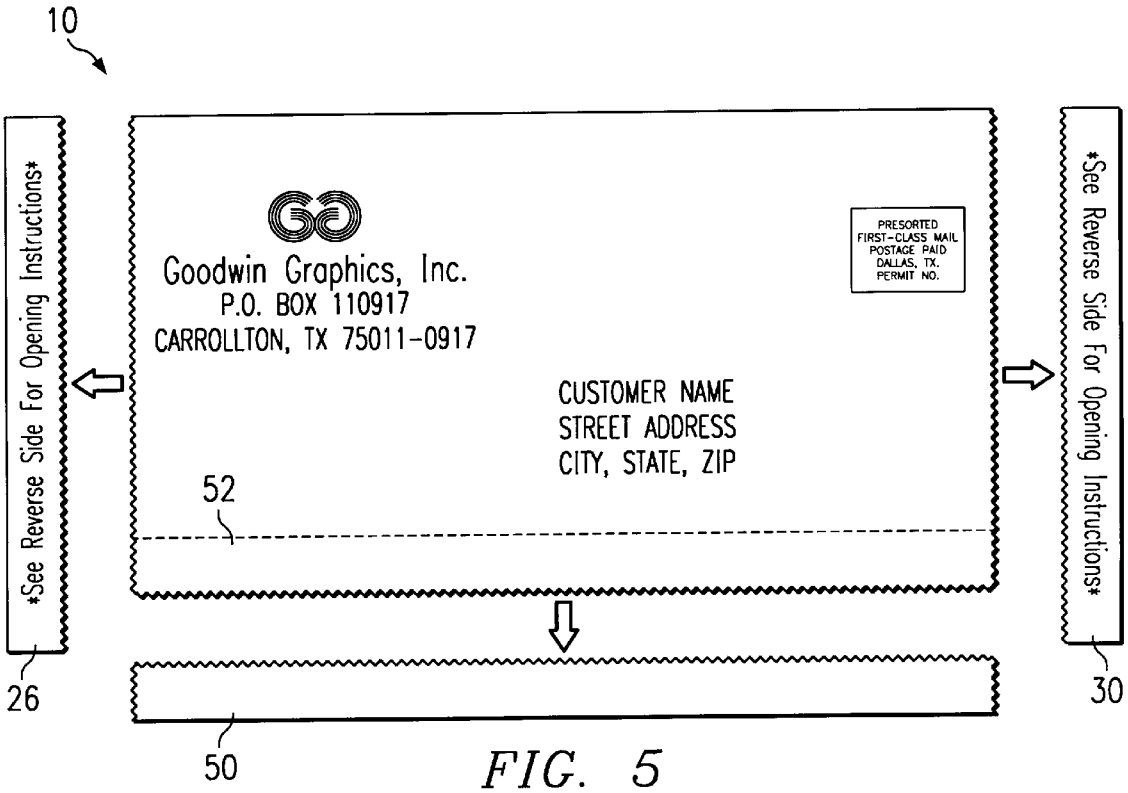
FIG. 5 is a front view of the sealed mailer being opened.
Figure 6:
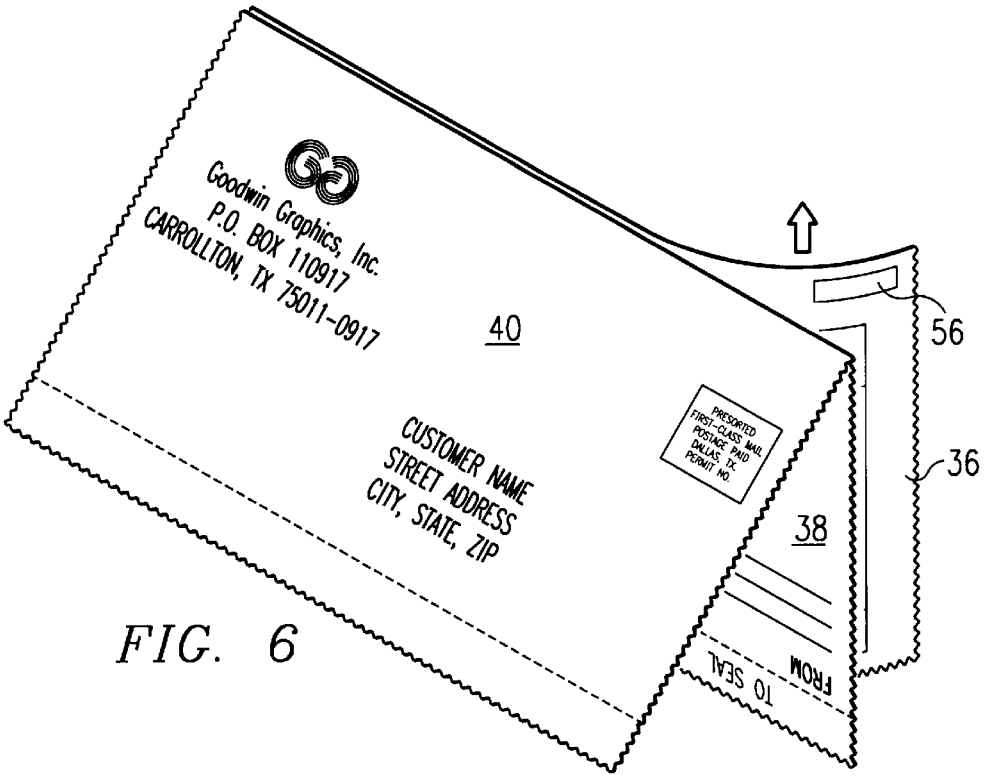
FIG. 6 is a perspective view of an opened mailer.

After the sealed mailer has been received by the recipient or addressee, it can be opened. As shown in FIG. 5. The perforated first and second tear-strips 26, 30 are first removed. Next, the perforated third tear-strip 50 is removed. The mailer can now be opened as shown in FIG. 6. After removal of the tear strips, the first, second and third sections 36, 38, 40 will all be connected at or about the second fold line 34. The second and third sections 38, 40 will be integrally connected at the second fold line 34, and the first and second sections 36, 38 will be connected only by the adhesive segments 56. The recipient of the mailer can view the contents of the mailer by flipping open the first and second sections 36, 38 to view the front faces thereof.

Figure 7:
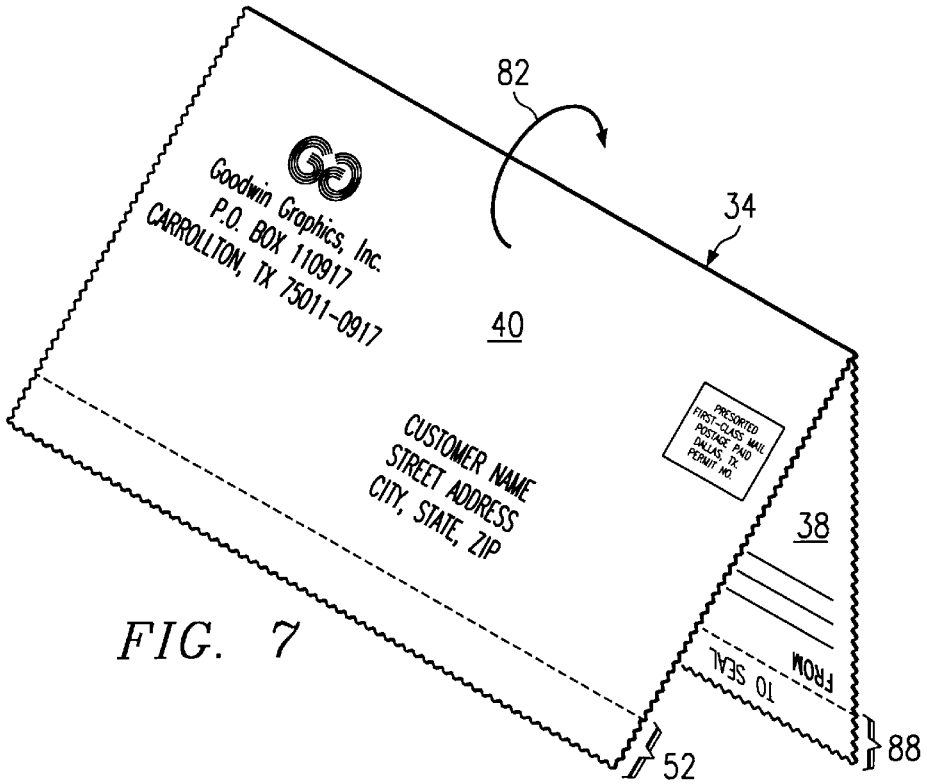
FIG. 7 is a perspective view illustrating a step in constructing a return envelope.

Construction of the return envelope 60 is illustrated in FIGS. 6–9. First, as shown in FIG. 6, the first section 36 is peeled off the second section 38. The first section 36 will preferably contain information that the addressee can keep for his or her records. Then, as shown in FIG. 7, the second and third sections 38, 40 are refolded about the second fold line 34 bringing the front faces 12 of the second and third sections 38, 40 together. In other words, the second and third sections 38, 40 are refolded about the second fold line 34 against the previously formed fold as indicated by arrow 82.

Figure 9:
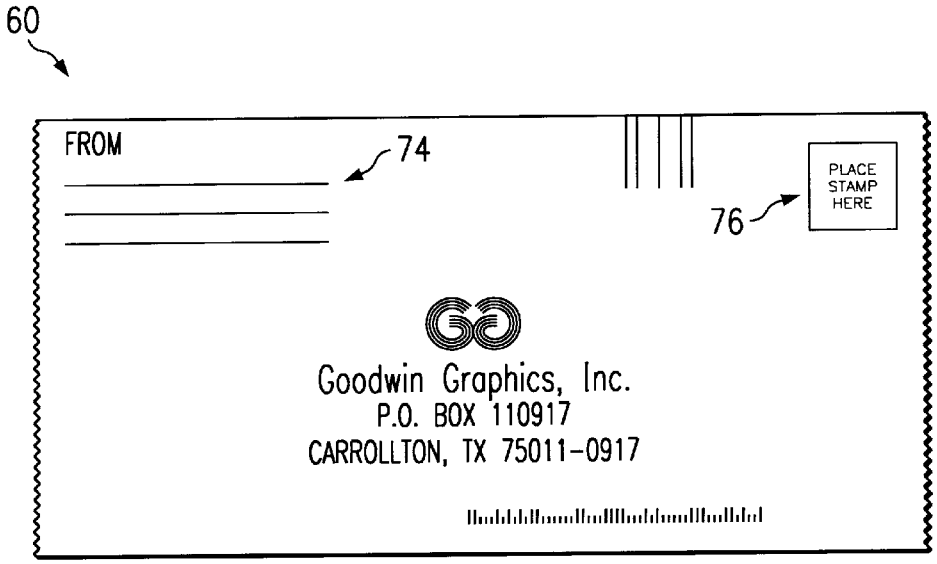
FIG. 9 is a front view of a sealed return envelope.

The fourth tear strip 52 is then torn off and discarded. Next, the open side edges 84, 86 of the second and third sections 38, 40 are sealed to form an open return envelope (shown in FIG. 8). The side edges 84, 86 are sealed using the side portions of the remoistenable adhesive 80 on the front face of the second section 38. An enclosure such as, e.g., a payment check can then be placed in the open return envelope 60. The envelope flap 88 containing the remainder of the remoistenable adhesive 80 is then folded about a flap fold line 90 (as indicated by instructions 80 shown in FIG. 2) to seal the top of the return envelope 60. The sealed return envelope is shown in FIG. 9. The sender's return address can be filled in at 74 and a postage stamp may be affixed at 76 to prepare the return envelope 60 for postal delivery.

The business form 10 thus can be quickly prepared for use. It can be printed with variable information using a simplex printer in a single feeding. It can also be easily folded and sealed for mailing. The addressee can conveniently construct a return envelope from the mailer.

Having thus described my invention, what I claim as new and desire to secure by letters patent is set forth in the following claims:

I claim:

1. A Z-fold business form mailer comprising a sheet having:

opposite front and rear faces;

opposite first and second edges;

opposite third and fourth edges joining said first and second edges;

a first line of weakness extending substantially parallel to and proximate said first edge, said first line of weakness and said first edge defining a first tear-away strip therebetween;

a second line of weakness extending substantially parallel to and proximate said second edge, said second line of weakness and said second edge defining a second tear-away strip therebetween;

first and second fold lines extending across said sheet substantially perpendicular to said first and second edges, said first and second fold lines dividing said sheet into first, second and third sections, wherein said first section is between said third edge and said first fold line, said second section is between said first and second fold lines, and said third section is between said second fold line and said fourth edge;

substantially parallel third and fourth lines of weakness on opposite sides of and proximate said first fold line, wherein said third line of weakness is in said first section, and said fourth line of weakness is in said second section;

a fifth line of weakness in said third section proximate said fourth edge of said sheet, said fifth line of weakness being aligned with said third and fourth lines of weakness when said sheet is folded at said first and second fold lines to define a third tear-away strip;

a sixth line of weakness proximate and substantially parallel to said fifth line of weakness, said fifth line of weakness being located between said sixth line of weakness and said fourth edge, said fifth and sixth lines of weakness defining a fourth tear-away strip therebetween;

adhesive material disposed on said first and second tear-away strips on said front face of said sheet for joining said first and second sections when said sheet is folded about said first fold line;

adhesive material on at least one of said second and third sections on said rear face of said sheet for joining said second and third sections when said sheet is folded about said second fold line; and adhesive material for constructing a return envelope disposed on at least one of said second and third sections on said front face of said sheet for joining at least some of an outer area of said second and third sections after folding said second and third sections about said second fold line.

2. The Z-fold business form mailer of claim 1, wherein said outer area is bounded by said first, second, fourth and sixth lines of weakness.

3. A two-way Z-fold mailer comprising a generally rectangular sheet having opposite first and second faces;

opposite first and second edges;

opposite third and fourth edges joining said first and second edges;

a first line of weakness extending substantially parallel to and proximate said first edge, said first line of weakness and said first edge defining a first tear-away strip therebetween;

a second line of weakness extending substantially parallel to and proximate said second edge, said second line of weakness and said second edge defining a second tear-away strip therebetween;

first and second fold lines extending across said sheet substantially perpendicular to said first and second edges, said first and second fold lines defining first, second and third sections of said sheet, said first section being between said third edge and said first fold line, said second section being between said first and second fold lines, and said third section being between said second fold line and said fourth edge;

substantially parallel third and fourth lines of weakness on opposite sides of and proximate said first fold line, said third line of weakness being in said first section and said fourth line of weakness being in said second section;

substantially parallel fifth and sixth lines of weakness in said third section proximate said fourth edge of said sheet, said fifth line of weakness being between said sixth line of weakness and said fourth edge, said fifth line of weakness being aligned with said third and fourth lines of weakness when said sheet is folded at said first and second fold lines to define a third tear-away strip, and said fifth and sixth lines of weakness define a fourth tear-away strip therebetween;

adhesive material disposed on said first and second tear-away strips on said first face of said sheet for joining said first and second sections when said sheet is folded about said first fold line;

adhesive material disposed on at least one of said first and second sections on the first face of said sheet for joining the third edge of said sheet to said second section proximate said second fold line when said sheet is folded about said first fold line;

adhesive material disposed on at least one of said second and third section on said first face of said sheet for joining at least some of an outer area of said second and third sections to form a return envelope when said sheet is folded about said second fold line, said outer area being bounded by said first, second, fourth and sixth lines of weakness; and adhesive material on at least one of said second and third sections on said second face of said sheet for joining said second and third sections.

4. The Z-fold mailer of claim 3, wherein said adhesive material disposed on at least one of said second and third sections on said first face comprises adhesive material disposed on said second section proximate said first line of weakness opposite said first tear-away strip, said adhesive material also disposed on said second section proximate said second line of weakness opposite said second tear-away strip, and said adhesive material also disposed on said second section proximate said fourth line of weakness opposite said third tear-away strip.

5. The Z-fold mailer of claim 3, wherein said adhesive material disposed on said first and second tear-away strips, said adhesive material disposed on at least one of said first and second sections on the first face, and said adhesive material on at least one of said second and third sections of said second face each comprises pressure-sensitive adhesive.

6. The Z-fold mailer of claim 3, wherein said adhesive material disposed on at least one of said second and third sections on said first face comprises remoistenable adhesive.

7. The Z-fold mailer of claim 3, wherein the adhesive material on said sheet comprises segments of adhesive arranged on said sheet.

8. The Z-fold mailer of claim 3, wherein said lines of weakness comprise lines of perforation.

9. The Z-fold mailer of claim 3, further comprising pre-printed information on said second section of said second face.

10. The Z-fold mailer of claim 9, wherein said pre-printed information includes an address of an addressee of the return envelope.

11. The Z-fold mailer of claim 3, further comprising pre-printed instructions on said sheet for opening a sealed mailer formed from said sheet.

12. The Z-fold mailer of claim 3, further comprising pre-printed instructions on said sheet for forming the return envelope.

* * * * *